United States Patent [19]

Henry et al.

[11] Patent Number: 5,053,086

[45] Date of Patent: Oct. 1, 1991

[54] GAS GENERANT COMPOSITIONS CONTAINING ENERGETIC HIGH NITROGEN BINDERS

[75] Inventors: Ronald A. Henry; Russell Reed, Jr.; May L. Chan, all of Ridgecrest, Calif.

[73] Assignee: The United States of America as represented by the Secretary of the Navy, Washington, D.C.

[21] Appl. No.: 733,480

[22] Filed: Mar. 15, 1985

[51] Int. Cl.[5] ..... C06B 45/10

[52] U.S. Cl. ..... 149/19.4; 149/19.6; 149/36

[58] Field of Search ..... 149/19.4, 19.6, 36

[56] References Cited

U.S. PATENT DOCUMENTS

| | | | |
|---|---|---|---|
| 2,710,793 | 6/1955 | Hutchison | 52/0.5 |
| 3,354,172 | 11/1967 | Takaes | 260/308 |
| 3,719,604 | 3/1973 | Prior et al. | 252/186 |
| 3,734,789 | 5/1973 | Moy et al. | 149/19.4 |
| 3,909,322 | 9/1975 | Chang et al. | 149/36 |
| 3,940,298 | 2/1976 | Beckert et al. | 149/19.1 |
| 3,954,528 | 5/1976 | Chang et al. | 149/19.4 |
| 4,234,364 | 11/1980 | Robinson | 149/19.4 |
| 4,358,327 | 11/1982 | Reed et al. | 149/19.4 |
| 4,405,762 | 9/1983 | Earl et al. | 149/109.4 |
| 4,483,978 | 11/1984 | Manger | 149/19.6 |
| 4,601,344 | 7/1986 | Reed et al. | 149/19.6 |

*Primary Examiner*—Edward A. Miller

*Attorney, Agent, or Firm*—Melvin J. Sliwka; Sol Sheinbein

[57] ABSTRACT

Gas generant compositions comprised of a high nitrogen content solid and an energetic polymer, which release high levels of nitrogen and minimum levels of toxic and flammable gases.

5 Claims, No Drawings

GAS GENERANT COMPOSITIONS CONTAINING ENERGETIC HIGH NITROGEN BINDERS

BACKGROUND OF THE INVENTION

1. Field of the Invention

This invention relates to gas generating compositions. More particularly this invention relates to gas generating compositions containing energetic high nitrogen content compounds. Still more particularly, but without limitation thereto, this invention relates to gas generating compositions containing high nitrogen content compounds such as ammonium 5-nitraminotetrazole, triaminoguanidinium 5-nitraminotetrazole, aminoguanidinium 5,5'-bitetrazole and guanidinium 5,5'-bitetrazole.

2. Description of the Prior Art

Conventional gas generants usually give off flammable ($H_2$) and highly toxic gases ($NO_x$, CO). Typical examples are ammonium nitrate with a cellulose acetate binder, ammonium nitrate rubber and double base gas generants. None of these are liquid castable.

The present invention provides gas generating compositions which are liquid castable in the manner of solid rocket propellants. Further, these compositions give off less flammable and toxic gases.

SUMMARY OF THE INVENTION

An object of this invention is to provide gas generating compositions which release high levels of nitrogen and minimum levels of toxic and flammable gases.

Another object of this invention is to provide gas generating compositions which are liquid castable.

A further object of this invention is to provide gas generating compositions which give a higher yield of permanent or non-condensable gases and which allows for tailoring of the burning rate.

These and still further objects, features and advantages of the present invention will become apparent upon consideration of the following detailed disclosure.

DESCRIPTION OF THE PREFERRED EMBODIMENT

The presently disclosed gas generant compositions are formulated from high nitrogen content compounds (solids) with energetic polymers. The preferred high nitrogen solids are: ammonium 5-nitraminotetrazole, triaminoguanidinium 5-nitraminotetrazole, aminoguanidinium 5,5'-bitetrazole and guanidinium 5,5'-bitetrazole.

The energetic polymers considered are those which contain at least 36% nitrogen and which are liquid curable rubbers. The preferred polymers are: a copolymer of 3,3-bis(azidomethyl) oxetane and 3-azidomethyl-3-methyloxetane (BAMO/AMMO), a copolymer of 3,3-bis(azidomethyl) oxetane and tetrahydrofuran (BAMO/THF), and a copolymer of 3,3-bis(azidomethyl) oxetane and 3-nitratomethyl-3-methyloxetane (BAMO/NMMO).

The preferred weight ratio of solids to polymer is about 50:50. This ratio provides satisfactory results since the polymer is comparable to the solid as a gas source. The polymer provides a high yield of gas comprised of hydrogen and nitrogen while the solid provides a gas with a high nitrogen content.

The 50:50 ratio is also preferred for optimum ease of processing. Increased burning rate can be achieved by increasing the amount of solids. However, processability will be hampered unless particle size distribution is optimized.

The desired amount of polymer is measured out and mixed with a curative. A multifunctional isocyanate is a suitable curative, more specifically the biuret trimer of hexamethylene diisocyanate.

The high nitrogen content solid is then added to form a uniform suspension. A catalyst such as dibutyltin dilaurate is also used. The solids ammonium 5-nitraminotetrazole and triaminoguanidinium 5-nitraminotetrazole, are synthesized by known methods. Aminoguanidinium 5,5'-bitetrazole is synthesized by dissolving 5,5'-bitetrazole (12.7g) and aminoguanidinium bicarbonate (12.5g) in boiling water (160 ml). The solution is filtered while hot and the filtrate rapidly chilled in an ice bath. The product is filtered off, washed twice with cold water and vacuum dried at 70° C., 25 mm to give a 91% (17.8g) yield of aminoguanidinium 5,5'-bitetrazole. The solid guanidinium 5,5'-bitetrazole is synthesized by adding a filtered solution of guanidinium bicarbonate (9.0g, 0.05 mole) in boiling water (75 ml) to a filtered boiling solution of 5,5'-bitetrazole (13.8g, 0.1 mole) in water (200 ml). The resulting solution is cooled rapidly in an ice-water bath. The white, crystalline product is removed by filtration, washed once with cold water and vacuum dried at 70° C., 25 mm to give a 95.6% (18.8g) yield of guanidinium 5,5'-bitetrazole.

Once the gas generant composition is prepared, it is then cured within the range of ambient temperature to 125° F. Curing time may range from 20 minutes to 24 hours.

Conventional gas generants exhibit burn rates in the range of 0.05–0.1 in/sec. For example, an ammonium nitrate and cellulose acetate composition has a burn rate of 0.059 in/sec. Significantly higher burn rates can be attained using high nitrogen content solids and energetic polymers. Table 1 gives burn rates for several compositions having a 50:50 weight ratio of polymer to solid. Measurements are made at 1000 psia.

TABLE 1

| POLYMER | SOLID | BURN RATE, in/sec |
|---|---|---|
| BAMO/AMMO[a] | ammonium 5-nitraminotetrazole | 0.66 |
| BAMO/THF[a] | aminoguanidinium 5,5'-bitetrazole | 0.25 |
| BAMO/NMMO[b] | guanidinium 5,5'-bitetrazole | 0.23 |
| BAMO/NMMO[a] | triaminoguanidinium 5-nitraminotetrazole | 0.58 |

[a]50:50 weight ratio of BAMO:AMMO, BAMO:THF and BAMO:NMMO
[b]40:60 weight ratio of BAMO:NMMO Table 2 compares the calculated flame temperature, yield in moles of gas per 100 g, percentages of nitrogen and water as well as moles of non-condensable gas per 100 g, for the same compositions as in Table 1 with a conventional gas generator. The high nitrogen content gas generants usually display an equivalent or higher flame temperature and yield of gas; however, they exhibit a higher yield of nitrogen and of non-condensable gas. A high yield of non-condensable gas is desirable for applications involving high pressures or low temperatures.

TABLE 2

| POLYMER | SOLID | FLAME TEMPERATURE, °F. | MOLES OF GAS[a] | % $N_2$ | % $H_2O$ | MOLES OF NON-CONDENSABLE GAS[a] |
|---|---|---|---|---|---|---|
| BAMO/AMMO | ammonium 5-nitraminotetrazole | 2291 | 5.09 | 38 | 0.7 | 5.04 |
| BAMO/THF | aminoguanidinium 5,5'-bitetrazole | 2119 | 4.91 | 42 | 0.7 | 4.88 |
| BAMO/NMMO | guanidinium 5,5'-bitetrazole | 1885 | 4.50 | 45 | 0.3 | 4.36 |
| BAMO/NMMO | triaminoguanidinium 5-nitraminotetrazole | 1986 | 5.01 | 38 | 0.2 | 4.85 |
| Cellulose Acetate | ammonium nitrate | 1901 | 4.91 | 17 | 22 | 3.32 |

[a]moles of gas per 100 g

This invention has been described in detail with particular reference to certain preferred embodiments thereof, but it will be understood that variations and modifications can be effected within the spirit and scope of the invention.

What is claimed is:

1. A composition of matter for use as a gas generant comprising:

a high nitrogen content solid selected from the group consisting of: ammonium 5-nitraminotetrazole, triaminoguanidinium 5-nitraminotetrazole, aminoguanidinium 5,5'-bitetrazole and guanidinium 5,5'-bitetrazole; and an energetic polymer selected from the group consisting of: a copolymer of 3,3-bis(azidomethyl) oxetane and 3-azidomethyl-3-methyloxetane, and a copolymer of 3,3-bis(azidomethyl) oxetane and 3-nitratomethyl-3-methyloxetane.

2. The composition of claim 1 wherein said high nitrogen content solid and said energetic polymer are present in about a 50:50 by weight ratio.

3. The composition of claim 1 which further comprises a curative, the biu trimer of hexamethylene diisocyanate.

4. The composition of claim 1 which further comprises a catalyst, dibutyltin dilaurate.

5. A composition of matter for use as a non-condensable gas generant comprising:

about 50 percent by weight of a high nitrogen content solid selected from the group consisting of: ammonium 5-nitraminotetrazole, triaminoguanidinium 5-nitraminotetrazole, aminoguanidinium 5,5'-bitetrazole and guanidinium 5,5'-bitetrazole;

about 50 percent by weight of an energetic polymer selected from the group consisting of: a copolymer of 3,3-bis (azidomethyl) oxetane and 3-azidomethyl-3-methyloxetane, and a copolymer of 3,3-bis-(azidomethyl) oxetane and 3-nitratomethyl-3-methyloxetane;

buret trimer of hexamethylene diisocyanate curative; and dibutyltin dilaurate catalyst.

* * * * *